US005579867A

United States Patent [19]

Jarrel

[11] Patent Number: 5,579,867

[45] Date of Patent: Dec. 3, 1996

[54] LUBRICATOR LADDER

[76] Inventor: Donald R. Jarrel, 4814 Vancouver Ave., Tulsa, Okla. 74107

[21] Appl. No.: 296,067

[22] Filed: Aug. 24, 1994

[51] Int. Cl.[6] ..... E06C 5/36

[52] U.S. Cl. ..... 182/206; 182/116; 182/163

[58] Field of Search ..... 182/116, 187, 182/136, 163, 164, 206, 107, 214; 248/230

[56] References Cited

U.S. PATENT DOCUMENTS

| | | | |
|---|---|---|---|
| 631,302 | 8/1899 | Harper . | |
| 1,142,072 | 6/1915 | Wingerd . | |
| 3,282,375 | 11/1966 | Ray | 182/163 |
| 3,498,410 | 3/1970 | Storch . | |
| 3,896,900 | 7/1975 | Hunter . | |
| 3,995,714 | 12/1976 | Brooks et al. . | |
| 4,379,498 | 4/1983 | Krusmark . | |
| 4,467,890 | 8/1984 | McCallum et al. . | |
| 4,722,420 | 2/1988 | Arthurs et al. | 182/116 X |
| 4,946,004 | 8/1990 | Buck . | |
| 4,995,476 | 2/1991 | Henson . | |
| 5,009,283 | 4/1991 | Prejean | 182/187 X |
| 5,024,292 | 6/1991 | Gilbreath | 182/163 X |
| 5,101,933 | 4/1992 | Hunley | 182/136 X |
| 5,109,954 | 5/1992 | Skyba . | |
| 5,295,556 | 3/1994 | Mullin | 182/116 X |
| 5,332,063 | 7/1994 | Amacker | 182/187 X |

FOREIGN PATENT DOCUMENTS

| | | | |
|---|---|---|---|
| 2622630 | 5/1989 | France | 182/107 |

*Primary Examiner*—Alvin C. Chin-Shue
*Attorney, Agent, or Firm*—Marcus L. Bates

[57] ABSTRACT

A safety ladder made special for attachment to a lubricator, or a vertically disposed pipe, which enables a person to safely scale the lubricator after it has been affixed to a well head. The improved safety ladder apparatus of this invention is externally attached to the lubricator in such a manner that a rigid triangular structure of great structural integrity results from the combination. The ladder forms the hypotenuse of the triangle and is attached at a comfortable downwardly sloped angle respective to the lubricator so that it is easy and safe to scale. The ladder has opposed side rails rigidly connected together by a plurality of spaced rungs, and an upper end opposed to a lower end. A seat or chair is attached to the upper end of the ladder and forms part of the ladder apparatus. There is an anchor device mounted at the top of the ladder that is in the form of a yoke. The yoke has a central part from which opposed legs extend into attached relationship respective to the seat at the top of the ladder. The yoke extends from the seat and is attached to the lubricator. A ladder standoff structure is attached between the lower end of the ladder and the lubricator to support the ladder lower end from the lubricator while stabilizing said lower end of said ladder such that the ladder is firmly attached at a downwardly sloped angle respective to the lubricator. Therefore the anchor yoke secures the upper end of the ladder closely adjacent to the lubricator while the standoff secures the lower end of the ladder spaced a relatively far distance from the lubricator and thereby presents a rigid structure of triangular configuration.

14 Claims, 2 Drawing Sheets

10
16
20
52
2
62
14
53
54
66
6-9
74
64
46
18
54'
12
91
53'
11
46
42
44
W 90
88
83
91
28
84
86
18
89
90
91'

30
20
40
26
32
53

82
89
90

20
38
30
60
32
36
17
33
22
40
34
26
28
24

10
53
28
66
74
72
70
62

53
62
14
78
76
10
76'
74
82
70
53'
72
12
28

LUBRICATOR LADDER

BACKGROUND OF THE INVENTION

Deep wells usually are provided with a well head, and sometime there are so many appurtenances attached to the well head that it becomes a Christmas tree. From time to time it is necessary to enter the borehole with various different downhole tools or apparatus which are run downhole into the wellbore, as for example, perforating guns; fishing tools; logging tools; instrument packages; special tools to set packers, and many other devices.

A lubricator is a long pipe section having special valves arranged thereon in a manner to permit various apparatus to be attached to a slick line, or wire line, passed through the interior of the lubricator, and thus introduced into the well bore. The wellhead has facilities by which the lubricator can be removably affixed thereto. One end of the lubricator is provided with an adaptor by which the lubricator is attached to the wellhead, with the other end extending vertically above the wellhead, thereby making it possible to translocate various tools or devices from ambient into the borehole.

The borehole usually has an internal pressure that is far above ambient and therefore specially trained technicians are entrusted with the task of translocating devices into the lubricator and thence into the borehole. It is necessary for the technicians to be present at the uppermost end of the lubricator to attend to a number of different tasks while lowering the various devices down through the lubricator and down into the borehole. It is dangerous to employ ordinary ladders for scaling the lubricator because of the everlasting messy condition of most well sites caused by the presence of crude oil from the wellhead and grease from the lubricator, all of which makes the well site or surroundings dangerously slippery.

Therefore it is desirable to have available a safety ladder made special for removable attachment to a lubricator, or a vertically disposed pipe, which enables a person to safely scale the lubricator after it has been affixed to a well head. Such a safety ladder apparatus is the subject of this invention.

SUMMARY OF THE INVENTION

This specification sets forth the precise invention for which a patent is solicited, in such manner as to distinguish it from other inventions and from what is old. This invention broadly comprehends the combination of a safety ladder and a lubricator. The lubricator is in the form of an elongated section of pipe with valves and packer devices arranged thereon to permit various different devices to be attached to a slick line, introduced into the lubricator, and run downhole into a borehole while being supported from the slickline.

The wellhead has facilities by which a lower end of the lubricator is removably affixed in axially aligned relationship thereto. The improved safety ladder apparatus of this invention includes means thereon for external attachment to the lubricator in such a manner that a rigid triangular structure of great structural integrity results from the combination. The ladder forms the hypotenuse of the triangle and is attached at a comfortable downwardly sloped angle respective to the lubricator and thereby renders the lubricator easy and safe to scale.

The ladder has opposed side rails rigidly connected together by a plurality of spaced rungs, and an upper end opposed to a lower end. A seat or chair is attached to said upper end of the ladder and forms part of the ladder apparatus. There is an anchor device mounted at the top of the ladder that is in the form of a yoke. The yoke has a central part from which opposed legs depend into attached relationship respective to the seat at the top of the ladder. The yoke therefore extends from said seat and receives said lubricator therewithin, by which said upper end of the ladder is removably attached or anchored to the upper end of the lubricator.

A ladder standoff structure is attached between the lower end of the ladder and the lubricator to thereby support the ladder lower end from the lubricator while stabilizing said lower end of said ladder in spaced relationship therewith such that the ladder is firmly attached to the lubricator at a downwardly sloped angle respective to the lubricator. Therefore the anchor yoke secures the upper end of the ladder closely adjacent to the lubricator while the standoff secures the lower end of the ladder spaced a relatively far distance from the lubricator and thereby presents a rigid structure of triangular configuration in spaced relationship therewith.

The seat, which is located at the upper end of the ladder, allows a technician to be safely seated at the top of the ladder with his arms and legs positioned to be extended about the lubricator if the need should arise. Accordingly the ladder apparatus completely embraces the lubricator in a structurally sound manner and is safely secured at a comfortable angle respective to the vertically upright lubricator.

A primary object of the present invention is the provision of a safety ladder apparatus that completely embraces a lubricator at the top and the bottom of the ladder, and is safely secured at an angle respective to the lubricator to assist a person trying to scale the lubricator after the lubricator has been attached to a well head in a vertically upright position.

Another object of the invention is to provide a safety ladder having opposed side rails rigidly connected together by a plurality of parallel, spaced, rungs, and an upper end opposed to a lower end; with a seat being attached to said upper end of the ladder and forming part of the ladder apparatus; and a yoke embracing the lubricator and having a central part from which opposed legs depend into attached relationship respective to the seat at the top of the ladder, while a standoff stabilizes the lower end of the ladder respective to the lubricator.

A further object of this invention is to disclose and provide a ladder and lubricator combination having a seat attached to the upper end of the ladder and secured or anchored to the lubricator by a yoke which extends from said seat to completely encircle the lubricator and thereby receive the lubricator therewithin, and a standoff securing the lower end of the ladder and spaced a relatively far distance from the lubricator to thereby present a rigid structure of triangular configuration.

A still further object of this invention is to provide a safety ladder made especially for lubricators, the ladder having a seat at the top thereof and having a yoke extending therefrom into attached relationship respective to the lubricator by which said upper end of the ladder is removably attached in anchored relationship to the lubricator, and a ladder standoff is attached between the lower end of the ladder and supports the ladder lower end from the lubricator while stabilizing said lower end of said ladder at a comfortable angle and in spaced relationship with respect to the lubricator.

Another and still further object of this invention is the provision of an improved safety ladder apparatus for external attachment to a lubricator used in conjunction with a wellbore, and arranged in such a manner that a rigid triangular structure results from the combination ladder, attachments, and lubricator which provides a structure that makes the lubricator easy and safe to scale.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENT

Figures 1, 2, 3, 4, 5, 6, 7:
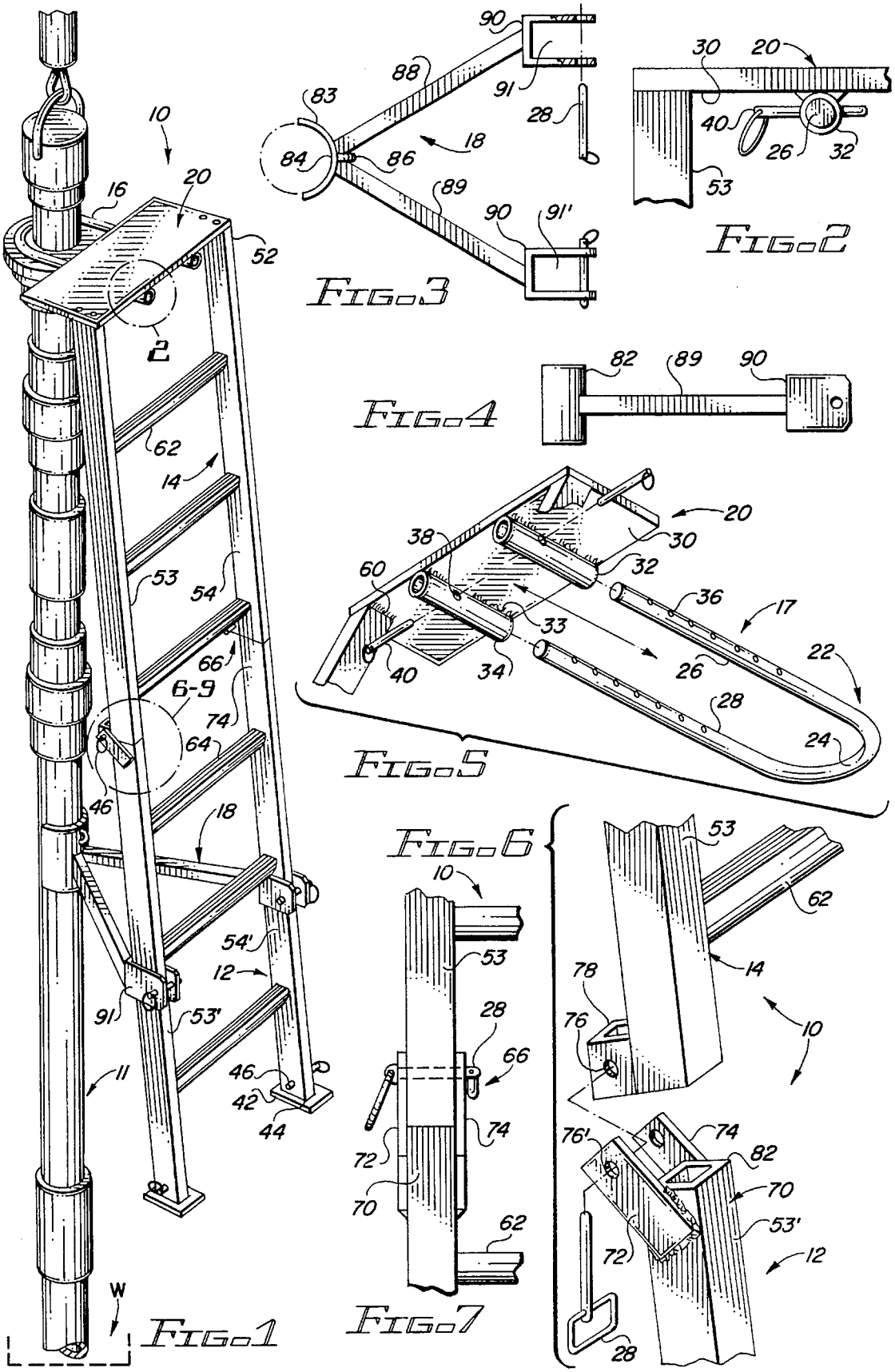
FIG. 1 is a perspective sideview of a safety ladder shown removably attached to a lubricator, which lubricator has been affixed to a well head.
FIG. 2 is a partial side view of a part of the safety ladder of FIG. 1 that has been circled and identified by the numeral 2.
FIG. 3 is an isolated plan view of another part of the apparatus disclosed in FIG. 1.
FIG. 4 is a side view of FIG. 3; showing a modification of part of the ladder of FIG. 3.
FIG. 5 is a perspective bottom view that illustrates another part of the apparatus seen disclosed in FIG. 1.
FIG. 6 is a perspective, dissembled, partial sideview of another part of the safety ladder of FIG. 1.
FIG. 7 is an assembled plan view of the part of the safety ladder illustrated in FIG. 6.
Figure 8:
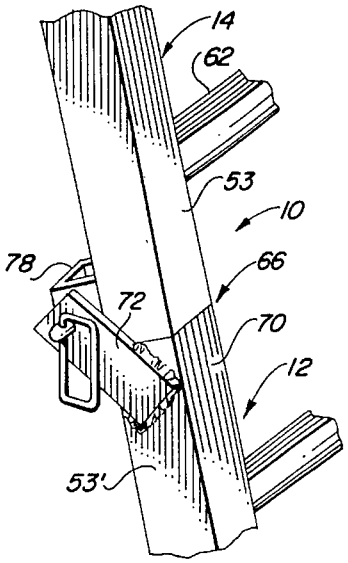
FIG. 8 is an assembled perspective view of the dissembled parts of the safety ladder illustrated in FIG. 6.

The attached drawing illustrates, as an example, the preferred embodiment of a safety ladder made according to this invention. This invention, as seen in FIG. 1, comprehends an improved safety ladder apparatus 10 shown in combination with a lubricator 11 that has been attached to a wellhead indicated by the arrow at W. The safety ladder apparatus 10 is hereinafter referred to as simply a ladder for brevity, which includes the apparatus by which the ladder is removably affixed to the lubricator 11. The lubricator can be any vertically disposed pipe or tubular goods that must be scaled by a workman.

Still looking at FIG. 1, together with other Figures of the drawings, the ladder 10 is shown sectioned, with there being a lower ladder extension 12 having an upper end that is removably attached respective to the bottom end of a main ladder section 14. At the upper end of the ladder there is an anchor device 16 that completely encircles the lubricator 11 and therefore embraces the lubricator 11 while a special lower stand off mount 18 positions the lower end of the ladder spaced a greater distance from the lubricator as compared to the upper end thereof, thereby rigidly supporting the ladder from the lubricator and forming a rigid triangular structural configuration therewith.

More specifically, a seat 20, illustrated in the form of a safety chair, is rigidly affixed to and forms the upper terminal end of the ladder. The anchor device 16, as best seen in FIG. 5, preferably is in the form of a yoke 22 having a rounded or semi-circular central portion 24 from which spaced parallel legs 26, 28 extend into attached relationship respective to the top of the ladder. Preferably, the yoke 22 is attached to the seat bottom 30, with the depending legs 26, 28 of the yoke being received within the illustrated parallel attachment sockets 32, 34. The sockets 32, 34 are rigidly attached to the seat bottom, as by welding at 33, and the marginal terminal end of the legs are apertured as shown in FIG. 5 at 36 and 38, with a pin 40 being received through the aligned apertures as shown in FIGS. 2 and 5, to thereby enable the size of the yoke opening to be easily selected.

Spaced apertures 21 receive a clevis at the end of the safety belt so that the worker is secured near the top of the ladder. Apertures 25 receive a clevis to attach a 3 foot length of safety chain to secure the top of the ladder to the lubricator.

Figure 12:
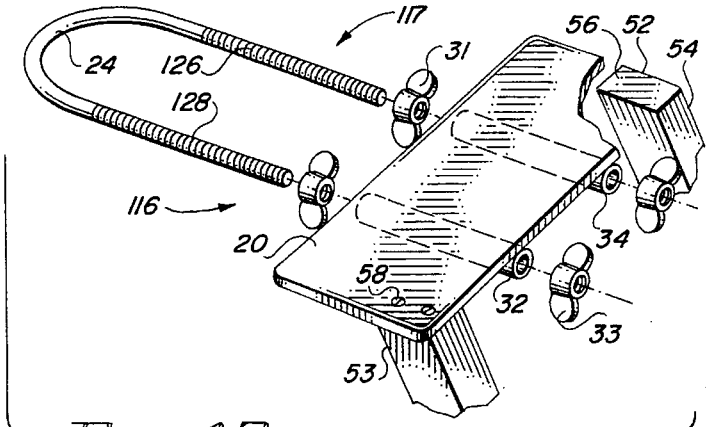
FIG. 12 is a perspective, dissembled, partial top view of another part of the safety ladder of FIG. 1; and, FIG. 13 is an enlarged, isolated, perspective, partial sideview of an alternate embodiment of part of the safety ladder of FIGS. 3 and 4.

The specific embodiment of the anchor device 116 of FIG. 12 can be employed to greatly increase the friction between the anchor yoke respective to the lubricator, where deemed desirable, and is especially suitable where the ladder is to remain attached to the lubricator for extended lengths of time. In FIG. 12, the marginal terminal ends 126, 128 of the yoke 24 is threaded and provided with wing nuts, 31 and 33, which can be tightened respective to the hollow sockets 32 and 33 to reduce the yoke opening and thereby firmly anchor and further enhance the safety of the ladder. Hence anchor yoke secures the upper end of the ladder closely adjacent to the lubricator while the standoff secures the lower end of the ladder spaced a relatively far distance from the lubricator and thereby presents a rigid structure of triangular configuration.

Figure 10:
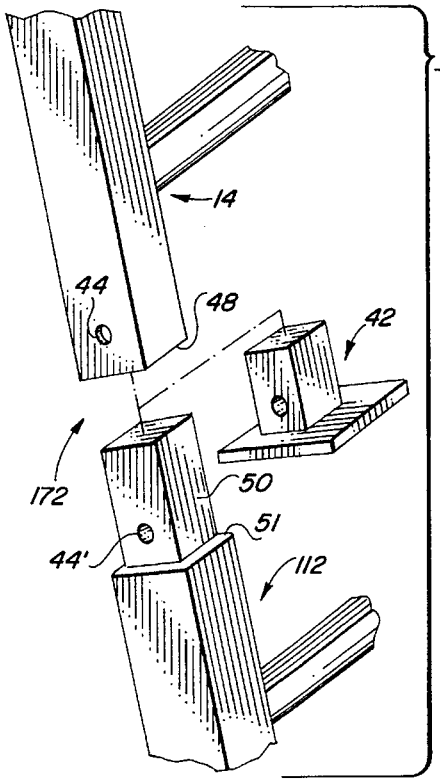
FIG. 10 is a perspective, dissembled, partial sideview of another part of the safety ladder of FIG. 1.
Figure 11:
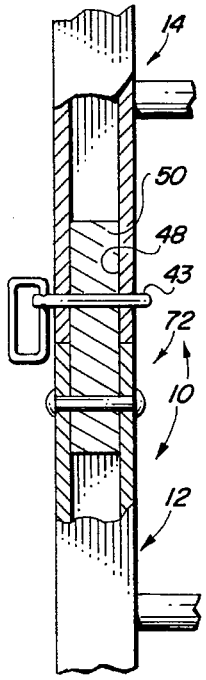
FIG. 11 is an assembled plan view of the dissembled part of the safety ladder illustrated in FIG. 10.

In FIGS. 1, 10, and 11, feet 42 are removably attached to the bottom 44 of the rails of the ladder section 12 by means of pins at 46 to thereby provide a dust cover as well as a temporary support for use during assembly of the apparatus. Further, the removable feet 42 can be pinned at the lower end of the upper or main section of the ladder when the extension, or lower section of the ladder, is not employed.

FIGS. 10 and 11 also set forth an alternate means of connecting the upper and lower ladder sections together by employment of pins 43 that are inserted through lateral apertures 44, 44' formed in the coacting ends of the ladder section 112 and 14, thereby pinning together the telescoped female connector socket 48 and male connector 50, respectively, of the upper and lower ladder sections, respectively. Shoulder 51 abuttingly receives the lower edge of the socket 48 to transfer loads therebetween.

The upper end 52 of each of the ladder side rails 53, 54 terminate in an abutment 56 (FIG. 12) which confronts the lower face 30 of the seat 20 and is rigidly affixed thereto by means of threaded fasteners 58, or by welding as seen at 60 (FIG. 5). Each of the abutments 56 lay in a common oblique plane that disposes the seat 20 in a horizontal plane that is arranged perpendicular respective to the lubricator 11.

The rails 53, 54 are connected together by the ladder rungs 62 of upper section 14. The rails 53', 54' of the extension section are a continuation of the main section 14 and are similarly connected together by ladder rungs 64. The upper end of ladder extension 12 is pivotally attached to the lower end of ladder main section 14 by means of a pivotal connection 66 that interconnect the rails, the details being more fully disclosed in FIGS. 6–9.

The upper end 70 of the lower section 12 is provided with oblique ears 72, 74 welded thereto which outwardly extend obliquely from opposed sides of each rail 53', 54' as shown. The ears are apertured at 76 and affixed by welding on opposed sides of the marginal terminal end of the lower extension rails. A short piece of rail stock 78 that is complementary respective to the cross section of the rails is affixed by welding to the lower marginal end of the upper rails and forms a combination stop and mount means for the coacting ladder sections 12, 14. The piece of rail stock 78 is pivotally received within the coacting spaced ears 72, 74 in the illustrated manner of FIGS. 7–8.

Figure 9:
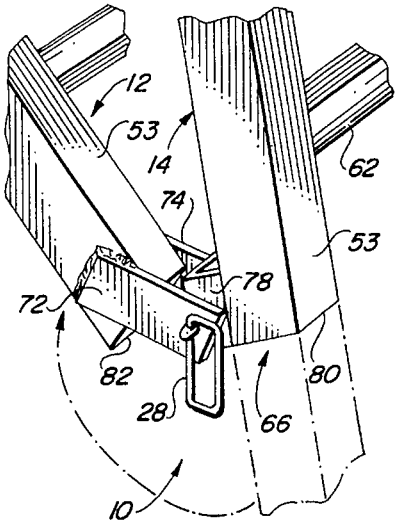
FIG. 9 is a perspective view of the safety ladder illustrated in FIG. 8, shown in an alternate operative configuration.

The ears 72, 74 are pined at 76, 76' to the combination mount and stop member 78 and form a pivot 66 for effecting limited pivotal motion between the upper and lower sections. It should be noted that the confronting terminal rail ends 80, 82 of the upper and lower sections abut one another to maintain the ladder sections aligned in a common plane when the ladder is attached to the lubricator and in use. This unique design enables the ladder sections to be folded in the reverse direction onto one another, as seen in FIG. 9, in order to retract the lower extension and thereby conserve space and facilitate assembly of the ladder to the lubricator as it is being attached to and removed from the wellhead.

In the embodiment illustrated in FIG. 1, 3, and 4, the stand-off mount 18 includes a centrally located semi-circular member 83 made from a short sectioned length of large diameter pipe. The inner curved surface 84 of the cylindrical member is provided with lugs 86, and welded to the near ends of the radial legs 88, 89. The member 83 can be affixed to the lubricator by the provision of chains or the like that may be attached at 86 and extended about the lubricator, noting provision having been made therefor.

The far end of the legs 88, 89 extend into attachment respective to a fixture 90, 90' which has the illustrated outwardly opening slot 91 therein that receives a side rail 53, 54 of the ladder pined therewithin.

Further, as seen illustrated in FIG. 10, additional sections 112 can be added to the ladder by means of the illustrated female connector 48 located at the lower end of the ladder that telescopingly receives in a removably manner the socket 50. The socket is a female receptacle that receives the male connector formed at the upper end of the extension.

Figure 13:
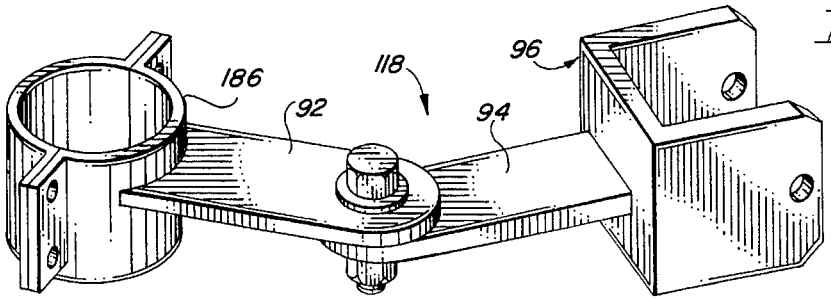

FIG. 13 sets forth an alternate embodiment 118 of another standoff apparatus that can be attached between the rails and the lubricator. It is necessary to employ a pair of the standoff devices 118, arranged one immediately above the other, with the length of the arms 92, 94 being adjusted by means of the fastener 93 to properly position the ladder respective to the lubricator. Each member 186 of a pair is attached to the lubricator while each fixture 96 thereof is connected to the ladder rails in a manner similar to the standoff apparatus 18 of FIG. 1.

In operation, the seat 20 at upper end of the ladder is positioned to comfortably seat a person at the top of the lubricator. The anchor yoke 40 is easily telescoped about the lubricator, and positioned about a half meter (1.5 feet) below the lubricator top usually against an enlargement such as a valve or packer device. Next, while it is not absolutely necessary to do so, the stand-off can be chained at 82 or otherwise secured about the lubricator. Yoke 40 can be tightened about the lubricator to further enhance the safety of the ladder. Where deemed desirable, according to the height of the lubricator, an additional lower ladder section can be fitted to the ladder extension in the manner of FIG. 10 to facilitate gaining access to the ladder 10.

Next, the lubricator is lifted into the air, carrying the ladder therewith, and set down on a wellhead where it is secured thereto in the illustrated manner of FIG. 1. Thereafter, a worker can safely climb onto the top of the wellhead and step over onto the bottom of the safety ladder, thereby gaining access to the upper end of the lubricator by climbing the ladder.

The oblique angle at end 34 of the rail is such that seat 16 is disposed perpendicular to the axial center line of the lubricator and accordingly, the seat is more or less horizontally disposed to accommodate a worker seated thereon. The worker may be seated at 16, where either of his legs and arms can be extended and wrapped about the lubricator if required, thus giving a great sense of security to the climber.

I claim:

1. The combination of a vertical, upright lubricator and a safety ladder for attachment to a well head, said ladder being removably attached to said lubricator for enabling a person to ascend the lubricator after the lubricator is connected to a wellhead;

said ladder having an upper end opposed to a lower end, and opposed side rails rigidly connected together by a plurality of spaced rungs; said side rails terminate in an oblique abutment at said upper end of the ladder; a seat having opposed faces with a lower face thereof being rigidly attached to said oblique abutment and thereby forms part of a ladder apparatus;

an anchor device at the upper end of said ladder, said anchor device is in the form of a continuous yoke having a central uninterrupted curved part which completely encircles and embraces the lubricator and from which opposed legs extend into attached relationship respective to said upper end of the ladder and thereby support the ladder closely adjacent to the lubricator and to thereby stabilize said upper end of said ladder;

a ladder standoff mount for rigidly supporting the ladder from the lubricator, said standoff mount having a far end removably attached to the lubricator and a near end attached to the lower end of the ladder to provide a right triangular structure that supports the ladder lower end at a greater distance from the lubricator relative to the ladder upper end and thereby stabilize said lower end of said ladder in spaced relationship therewith such that the ladder is attached at an angle to downwardly slope respective to the lubricator; said ladder standoff mount being the base of the triangle, with said lubricator being the side opposite the ladder rails which are the hypotenuse;

whereby the ladder apparatus completely embraces the lubricator and is safely secured at an angle respective to the vertical upright lubricator.

2. The combination of claim 1 wherein said standoff mount includes a centrally located member of a size to receive the lubricator therewithin, and having a pair of legs, each of said leas have a near end opposed to a far end, the near ends of said pair of legs being attached thereto and radiating therefrom and into engagement with the side rails, and thereby forming a triangular structure with respect to the ladder rungs, said centrally located member includes a cylindrical member being positioned to embrace the lubricator, and having an inner surface which bears against the lubricator.

3. The combination of claim 1 wherein said yoke has a central portion from which spaced parallel legs extend into attached relationship respective to the upper end of the ladder;

means attaching a pair of spaced attachment sockets to said seat lower force, means attaching said legs of said yoke to said pair of spaced attachment sockets; whereby, the length of the legs may be adjusted to enable the size of the yoke opening to be selected.

4. The combination of claim 1 wherein the ladder has a main section at the upper end thereof and a lower extension, a hinge pivotally connecting said lower extension to said main section; said hinge is a pair of oblique ears fastened to opposed sides of an upper marginal end of the lower extension rails, said oblique ears outwardly extend from each rail thereof;

a mount for said ears comprising a relatively short section of rail stock made complementary respective to the cross section of the rails and affixed to a lower marginal end of the main section to thereby form a combination stop and mount means for the coacting ladder sections; the section of rail being received within the coacting spaced ears, and, the ears and the mount being apertured and pined together to form the recited hinge.

5. The combination of claim 4 wherein said ladder standoff mount supports the ladder extension from the lubricator while stabilizing said ladder extension in spaced relationship therewith such that the ladder is attached to the lubricator at a downwardly sloped angle respective to the lubricator with the lower end of the ladder being spaced from the ground; said yoke being positioned to secure the upper end of the ladder closely adjacent to the top of the lubricator while the standoff mount secures the lower end of the ladder spaced a relatively far distance from the lower end of the lubricator, thereby forming said triangle that is described by the lubricator, ladder, and standoff mount; the latter being the base and the ladder being the hypothenuse of the triangle.

6. A safety ladder in combination with a lubricator, said ladder having upper and lower attachment means by which the ladder may be removably attached to the lubricator for enabling a person to safely ascend the ladder when the lubricator is vertically disposed and thereby gain access to the upper end of the lubricator:

said ladder having an upper end opposed to a lower end, and opposed side rails rigidly connected together by a plurality of spaced rungs; a seat attached to said upper end and forming part of a ladder apparatus; said upper attachment means includes a yoke having a continuous central part from which opposed legs are attached to and extend towards said seat, and by which said upper end of the ladder is removably attached to the lubricator; said yoke central part is spaced from said seat and receives said lubricator therewithin to secure the upper end of the ladder against the lubricator;

a ladder standoff mount attached to the ladder in underlying relationship respective to said yoke and supported from the lubricator by which said lower end of said ladder is stabilized in spaced relationship therewith such that the ladder is attached at an angle and downwardly slopes respective to the lubricator;

whereby the ladder apparatus completely embraces the lubricator and is safely secured at an angle respective to the lubricator when the lubricator is attached to a wellhead.

7. The safety ladder apparatus of claim 6 wherein said standoff mount includes a centrally located outwardly opening member of a size to receive the lubricator therewithin, and having a pair of legs radiating therefrom and into engagement with the ladder rails;

said ladder has a main section that forms the upper end thereof and a lower extension pivotally hinged thereto by a pair of oblique ears fastened to opposed sides of an upper marginal end of the lower extension rails, said oblique ears outwardly extend from each rail thereof; and, a mount for said ears comprising a relatively short section of rail stock made complementary respective to the cross section of the rails and affixed to a lower marginal end of the main section to thereby form a combination stop and mount means for a coacting ladder sections; the section of rail being received within the ears; and, the ears and the mount being apertured and pined together to form the recited hinge.

8. The safety ladder apparatus of claim 6 wherein said ladder having coacting main and lower extension sections which are hinged together by a pair of oblique ears fastened to opposed sides of an upper marginal end of the lower extension rails, said oblique ears outwardly extend from each rail thereof, a mount for said ears comprising a relatively short section of rail stock made complementary respective to the cross section of the rails and affixed to a lower marginal end of the main section to thereby form a combination stop and mount means for the coacting ladder sections; the section of rail being received within the ears, and, the ears and the mount being apertured and pined together to form the recited hinge;

said seat is attached to the ladder in a position that allows a technician to be safely seated with his arms and legs positioned to be extended about the lubricator.

9. The safety ladder apparatus of claim 6 wherein said seat is rigidly affixed to and forms part of the upper end of the ladder;

means by which the length of said yoke legs may be adjusted to enable the size of the yoke opening to be selected so as to greatly increase the friction between the anchor yoke respective to the lubricator.

10. The safety ladder apparatus improvement of claim 6 wherein said ladder standoff mount is attached between the ladder and the lubricator to thereby support the ladder lower end from the lubricator while stabilizing said lower end of said ladder such that the ladder is attached to the lubricator at a downwardly sloped angle respective to the lubricator; said yoke secures the upper end of the ladder closely adjacent to the lubricator while the standoff mount secures the lower end of the ladder spaced a relatively far distance from the lubricator, thereby forming a right triangle between the lubricator, ladder, and standoff mount, the latter being the base of the triangle and the ladder being the hypothenuse.

11. In a wellhead having means by which a vertical upright lubricator is removably affixed thereto, the combination with said lubricator of an improved safety ladder apparatus for external attachment to the lubricator to provide a rigid, triangular structure; said ladder apparatus includes a ladder having opposed side rails rigidly connected together by a plurality of spaced rungs, and an upper end opposed to a lower end;

a seat attached to said upper end and forming part of the ladder apparatus; a yoke having a continuous central part from which a pair of legs extend into attached relationship respective to said seat by which the ladder upper end is removably attached to the lubricator; whereby, said yoke extends from said seat and telescopingly receives said lubricator therewithin;

a ladder standoff mount attached to the lower end of the ladder and extends between the ladder and the lubricator into attached relationship respective to the lubricator to thereby support the ladder from the lubricator while stabilizing said lower end of said ladder in spaced relationship therewith such that the ladder is attached to the lubricator at a downwardly sloped angle respective to the lubricator;

said standoff mount is a structure that includes a centrally located outwardly opening member of a size to receive the lubricator therewithin, and having a pair of legs radiating therefrom and into engagement with the ladder rails, thereby forming a triangular structure with respect to said ladder; the central member having an inner surface which bears against the lubricator;

whereby; the ladder apparatus completely embraces the lubricator and is safely secured at an angle respective to said vertical upright lubricator with the lower end of the ladder being free of the ground.

12. The combination of claim 11 wherein said seat having a bottom and rigidly affixed to and forming part of the upper end of the ladder; said yoke having spaced parallel legs extending into attached relationship respective to the seat bottom, spaced sockets rigidly affixed to the seat bottom, said legs of the yoke being received within said sockets, a marginal terminal end of the legs may be changed in length to enable the size of the yoke opening to be selected so as to greatly increase the friction between the yoke respective to the lubricator.

13. The combination of claim 11 wherein the ladder has a main section at the upper end thereof and hinge means by which a lower extension is pivotally hinged thereto; said hinge means is a pair of oblique ears fastened to opposed sides of an upper marginal end of the lower extension rails, said oblique ears outwardly extend from each rail thereof, a mount on the main ladder section by which said ears are hingedly supported comprising a relatively short section of rail stock made complementary respective to the cross section of the rails and affixed to a marginal end of the main ladder section to thereby form a combination stop and mount means for the ladder section and extension; said section of rail is received within the ears, and, the ears and the mount being apertured and pined together to form the recited hinge.

14. The combination of claim 11 wherein said ladder standoff mount is attached between the lower end of the ladder and the lubricator to thereby support the ladder lower end from the lubricator while stabilizing said lower end of said ladder in spaced relationship therewith such that the ladder is attached to the lubricator at a downwardly sloped angle respective to the lubricator; said yoke provides means for securing the upper end of the ladder closely adjacent to the lubricator while the standoff mount provides means for securing the lower end of the ladder spaced a relatively far distance from the lubricator, thereby forming a right triangle between the lubricator, ladder, and standoff mount, the latter being the base of the triangle and the ladder being the hypothenuse.

* * * * *